US010551027B1

(12) United States Patent
Lee

(10) Patent No.: US 10,551,027 B1
(45) **Date of Patent: *Feb. 4, 2020**

(54) ILLUMINATION STRUCTURE FOR LAMP

(71) Applicant: Hui-Lun Lee, New Taipei (TW)

(72) Inventor: Hui-Lun Lee, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/509,457

(22) Filed: Jul. 11, 2019

Related U.S. Application Data

(63) Continuation-in-part of application No. 16/106,834, filed on Aug. 21, 2018, now Pat. No. 10,422,516.

(51) Int. Cl.

| | |
|---|---|
| ***F21V 1/00*** | (2006.01) |
| ***F21V 7/04*** | (2006.01) |
| ***F21V 19/00*** | (2006.01) |
| ***F21V 17/12*** | (2006.01) |
| *F21Y 103/33* | (2016.01) |
| *F21Y 115/10* | (2016.01) |
| *F21S 8/06* | (2006.01) |
| *F21V 7/00* | (2006.01) |

(52) U.S. Cl.
CPC ..... *F21V 1/00* (2013.01); *F21V 7/041* (2013.01); *F21V 17/12* (2013.01); *F21V 19/0055* (2013.01); *F21S 8/065* (2013.01); *F21V 7/0058* (2013.01); *F21Y 2103/33* (2016.08); *F21Y 2115/10* (2016.08)

(58) Field of Classification Search
CPC ..... F21V 1/00; F21V 7/0058
See application file for complete search history.

(56) References Cited

U.S. PATENT DOCUMENTS 3,852,584 A * 12/1974 Levin ..... F21V 7/0058 362/216
2013/0223085 A1* 8/2013 Peng ..... F21V 1/00 362/477

* cited by examiner

*Primary Examiner* — Tho D Ta
(74) *Attorney, Agent, or Firm* — Chun-Ming Shih; LanWay IPR Services

(57) ABSTRACT

A lamp structure contains: a lampshade, a transmission cap, and an illumination element. The lampshade is tubular and includes a first orifice and a second orifice which are defined on two ends of the lampshade respectively. The lampshade is opaque and includes a reflective face formed on an inner wall thereof. The transmission cap is tubular and is accommodated in the lampshade, and a gap is defined between the transmission cap and the reflective face. The illumination element is defined between the transmission cap and the reflective face of the lampshade. One part of lights penetrates through the transmission cap from the illumination element, another lights emit out of a front side of the lamp structure via the reflective face, the transmission cap and the first orifice, and the other lights illuminate out of a rear side of the lamp structure via the second orifice.

11 Claims, 8 Drawing Sheets

ILLUMINATION STRUCTURE FOR LAMP

This application is a Continuation-in-Part of application Ser. No. 16/106,834, filed on Aug. 21, 2018.

BACKGROUND OF THE INVENTION

Field of the Invention

The present invention relates to a lamp structure which emits lights out of two ends of the lamp after adjusting the lamp to a desired direction.

Description of Related Art

A conventional lamp is applied to illuminate lights. However, it is important to enhance decoration and ambience.

The present invention has arisen to mitigate and/or obviate the afore-described disadvantages.

SUMMARY OF THE INVENTION

The primary object of the present invention to provide a lamp structure which emits lights out of two ends of the lamp after adjusting the lamp to a desired direction To achieve the above object, a lamp structure provided by the present invention contains: a lampshade, a transmission cap, and an illumination element.

The lampshade is tubular, and the lampshade includes a first orifice and a second orifice which are defined on two ends of the lampshade respectively. The lampshade is opaque and includes a reflective face formed on an inner wall thereof.

The transmission cap is tubular and is accommodated in the lampshade, and a gap is defined between the transmission cap and the reflective face.

The illumination element is defined between the transmission cap and the reflective face of the lampshade. One part of lights penetrates through the transmission cap from the illumination element, another lights emit out of a front side of the lamp structure via the reflective face, the transmission cap and the first orifice, and the other lights illuminate out of a rear side of the lamp structure via the second orifice.

DETAILED DESCRIPTION OF THE PREFERRED EMBODIMENT

Figure 1:
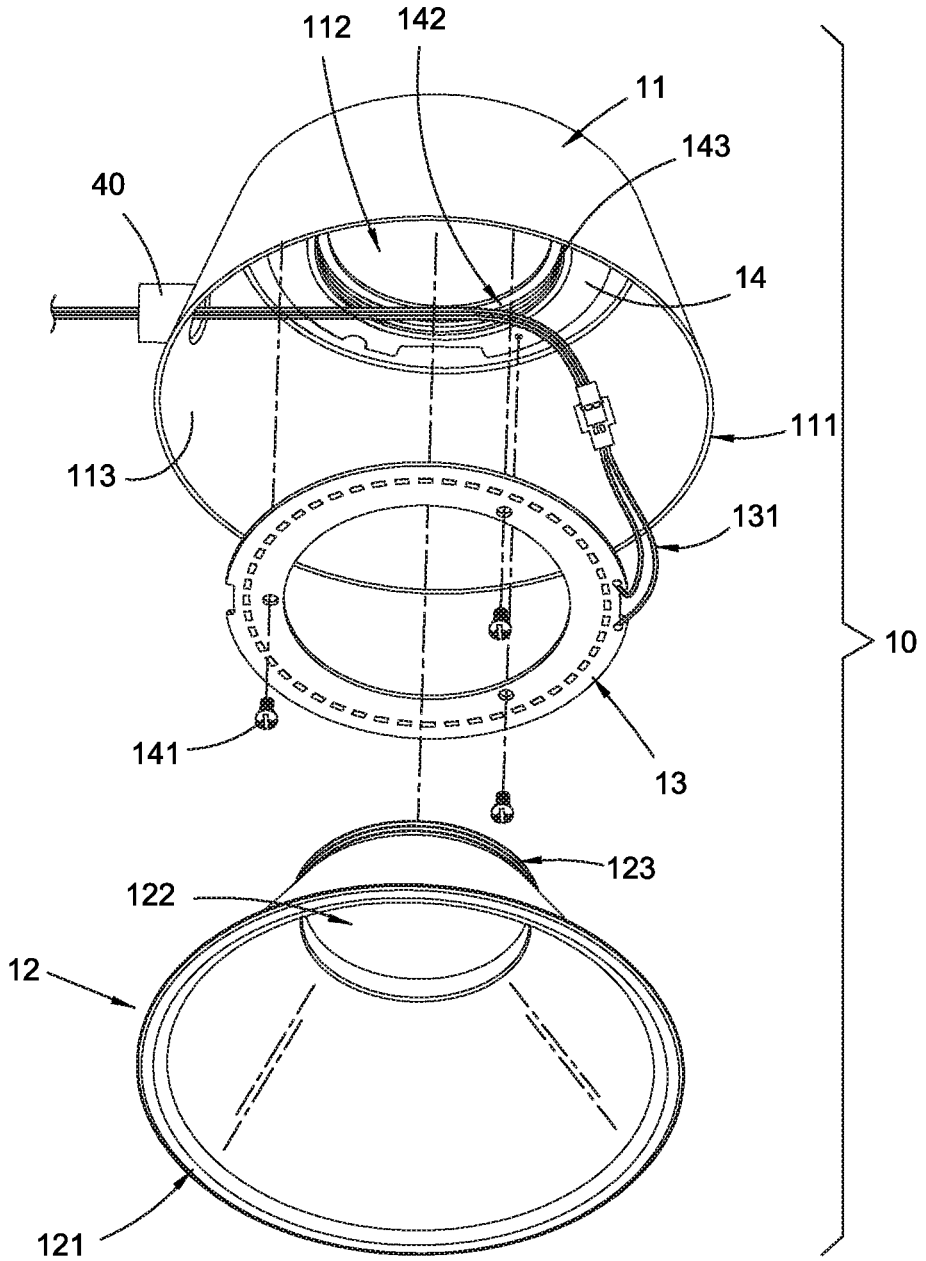
FIG. 1 is a perspective view showing the exploded components of a lamp structure according to a first embodiment of the present invention.

With reference to FIG. 1, a lamp structure 10 according to a first embodiment of the present invention comprises: a lampshade 11, a transmission cap 12, and an illumination element 13.

Figure 3:
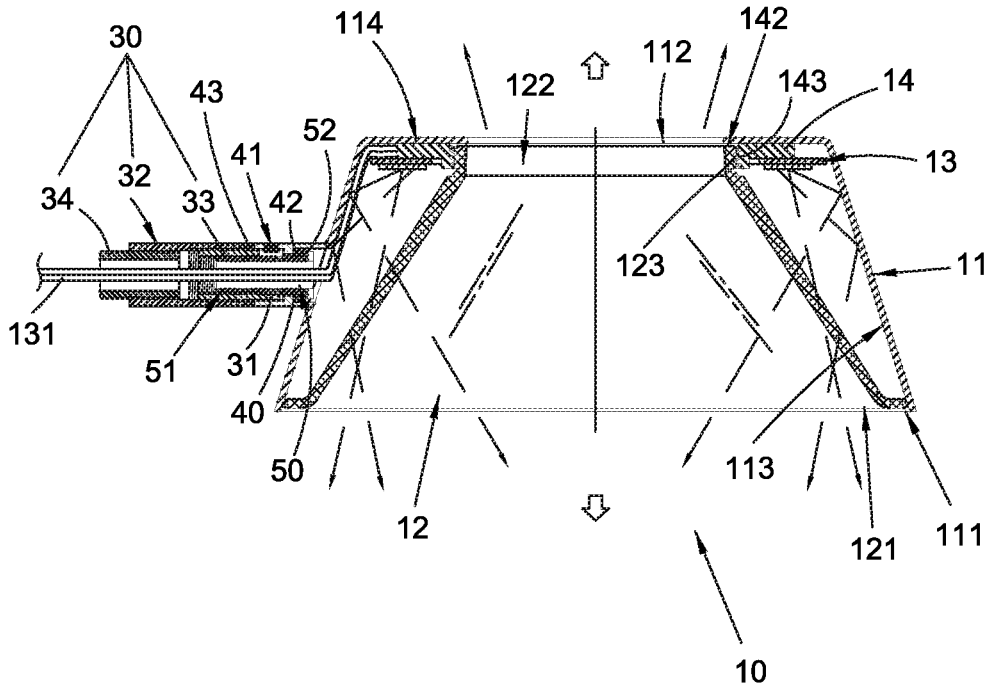
FIG. 3 is a cross sectional view showing the assembly of the lamp structure according to a second embodiment of the present invention.

The lampshade 11 is opaque and tubular, and the lampshade 11 includes a first orifice 111 and a second orifice 112 which are defined on two ends of the lampshade 11 respectively (as shown in FIG. 3), wherein the lampshade 11 is made of aluminum or aluminum alloy so as to enhance heat dissipation. The lampshade 11 includes a reflective face 113 formed on an inner wall thereof, and the reflective face 113 is made of metal and is polished or electroplated. The lampshade 11 is formed in a conical tube, and a diameter of the first orifice 111 is more than the second orifice 112.

The transmission cap 12 is tubular and is accommodated in the lampshade 11, wherein a gap is defined between the transmission cap 12 and the reflective face 113, and the transmission cap 12 is transparent and is matte, wherein the transmission cap 12 is made of any one of matte glass, acrylic, and plastic. The transmission cap 12 is formed in a conical tube, and the transmission cap 12 includes a first opening 121 and a second opening 122 which are formed on two ends of the transmission cap 12 respectively, wherein a diameter of the first opening 121 is more than the second opening 122, the first opening 121 is close to the first orifice 111 of the lampshade 11, and the second opening 122 is close to the second orifice 112 of the lampshade 11.

The illumination element 13 is defined between the transmission cap 12 and the reflective face 113 of the lampshade 11, and the illumination element 13 is any one of a circular LED light board, multiple light-emitting diodes (LEDs) which are arranged in a circular shape, and a circular fluorescent tube.

The lampshade 11 includes a circular top face 114 formed on an end thereof, and the circular top face 114 has the second orifice 112 defined on a center thereof. The illumination element 13 is received inside the circular top face 114, the second opening 122 of the transmission cap 12 is connected with the second orifice 112 of the lampshade 11, and the first opening 121 of the transmission cap 12 is connected with the first orifice 111 of the lampshade 11.

The circular top face 114 of the lampshade 11 includes a fixing plate 14, the fixing plate 14 and the illumination element 13 are screwed on an inner wall of the circular top face 114 by ways of multiple screw bolts 141 and are close to the second orifice 112. The illumination element 13 is located below the fixing plate 14 clamped between the inner wall of the circular top face 114 and the illumination element 13, the fixing plate 14 has a circular connection aperture 142 having first threads 143, and the second opening 122 of the transmission cap 12 has second threads 123 formed on an outer wall thereof, wherein the second threads 123 of the transmission cap 12 are screwed with the first threads 143 of the circular connection aperture 142 of the fixing plate 14.

Referring to FIG. 3, one part of lights penetrates through the transmission cap 12 from the illumination element 13, another lights emit out of a front side of the lamp structure 10 via the reflective face 113, the transmission cap 12 and the first orifice 111, and the other lights illuminate out of a rear side of the lamp structure 10 via the second orifice 112, thus illuminating entire lights out of the front and rear sides of the lamp structure 10.

Figure 2:
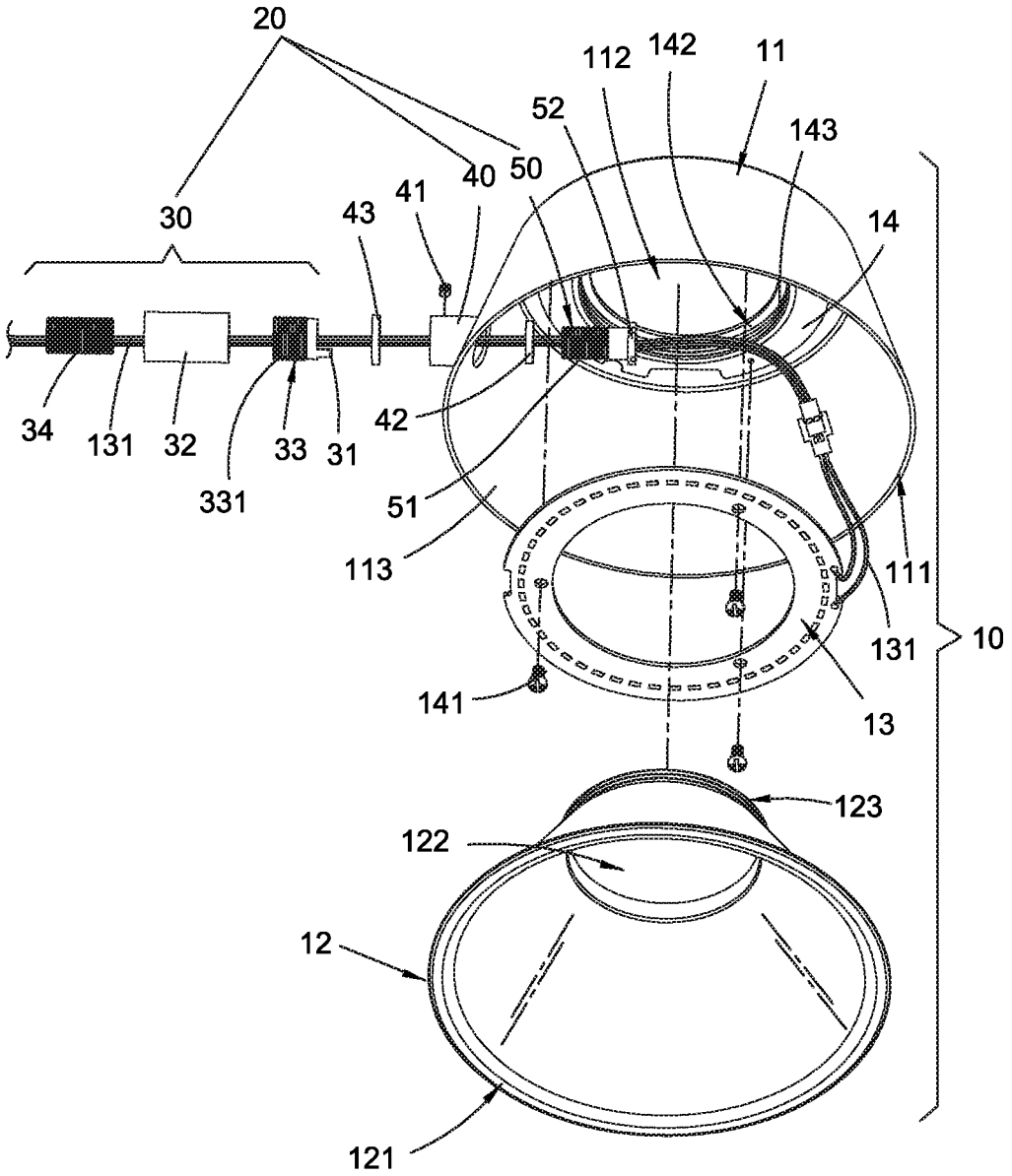
FIG. 2 is a perspective view showing the exploded components of a lamp structure according to a second embodiment of the present invention.
Figure 4:
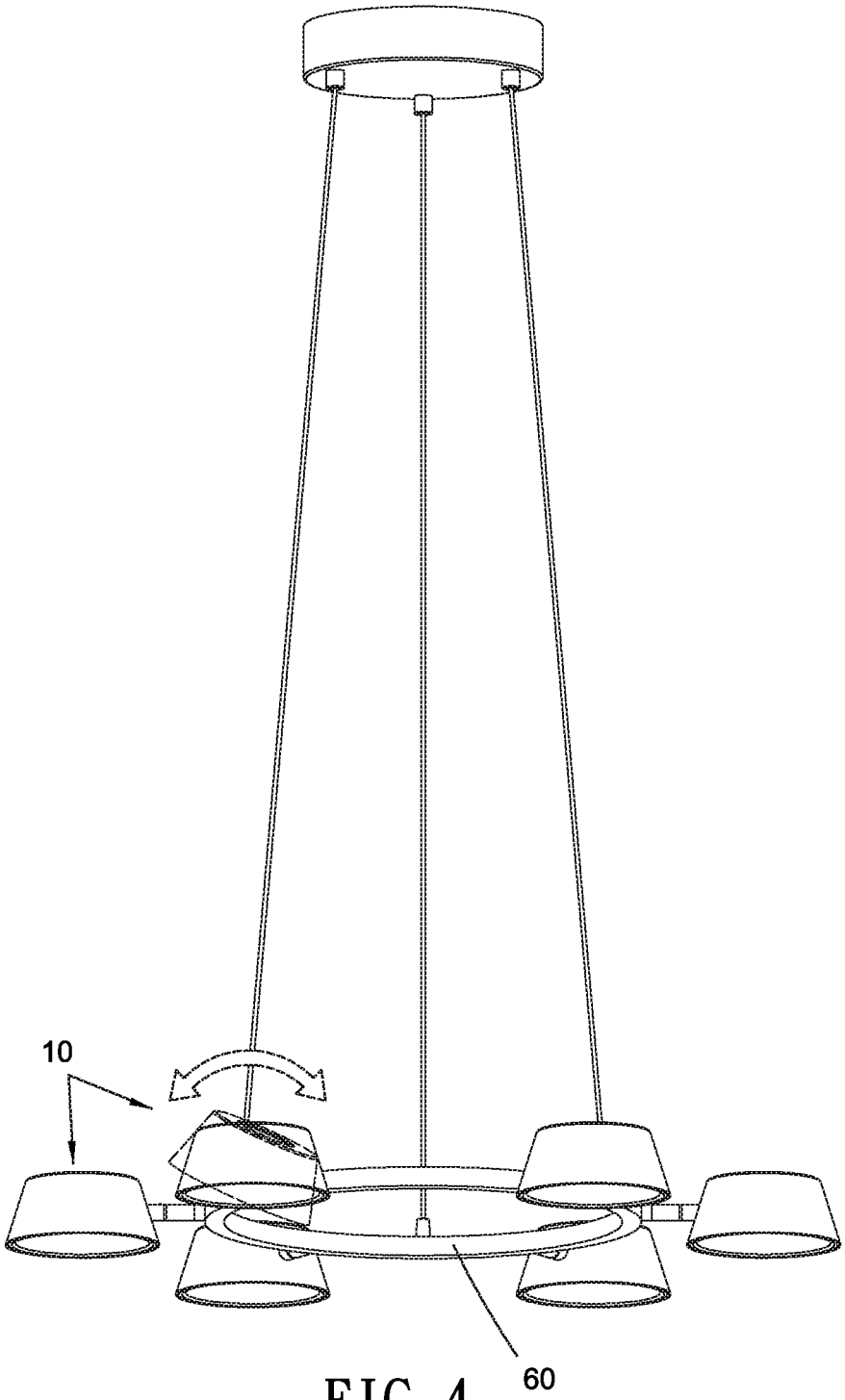
FIG. 4 is a perspective view showing the application of the lamp structure according to the second embodiment of the present invention.
Figure 5:
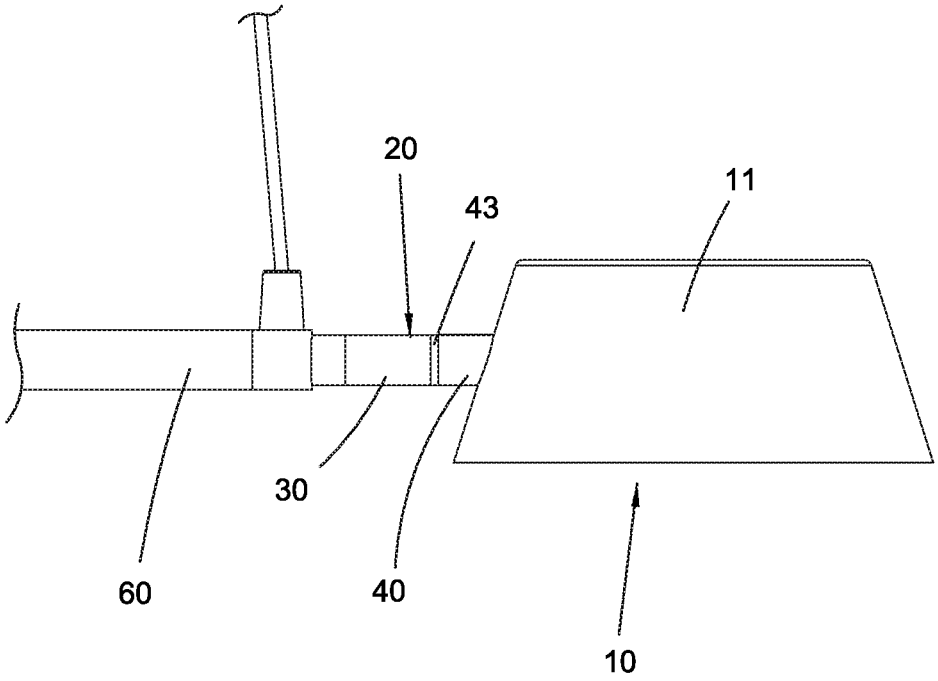
FIG. 5 is a plan view showing the application of a part of the lamp structure according to the second embodiment of the present invention.
Figure 7:
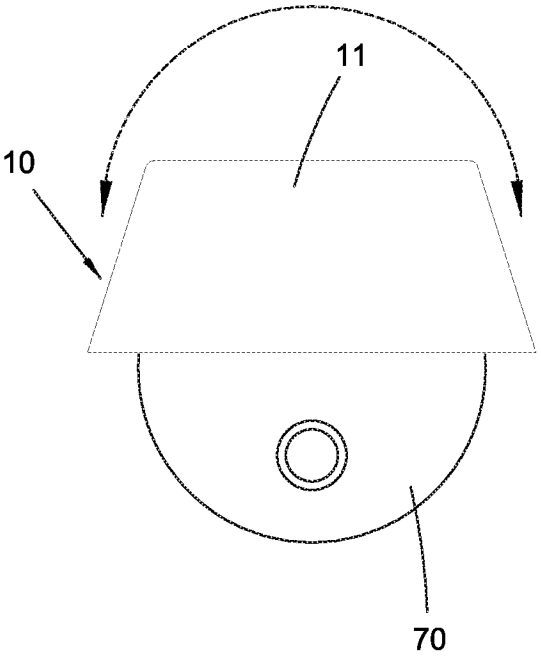
FIG. 7 is a plan view showing the application of a part of the lamp structure according to the second embodiment of the present invention.
Figure 6:
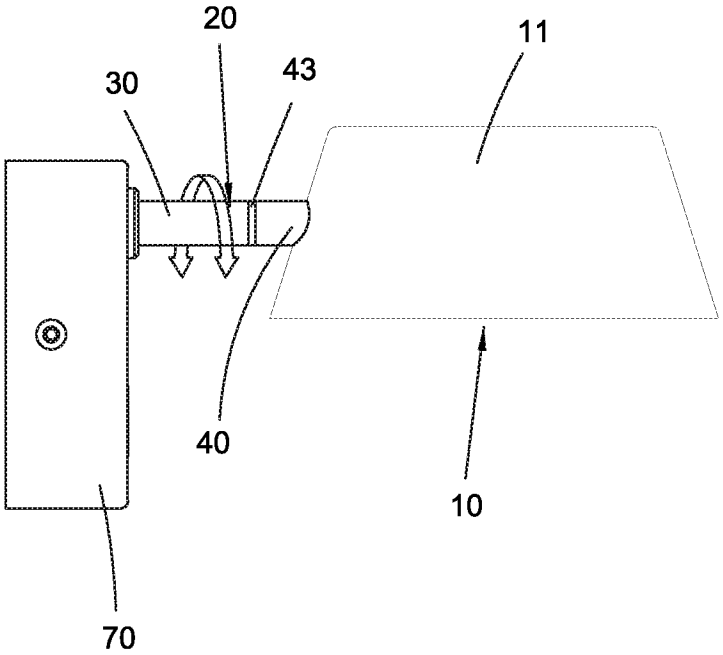
FIG. 6 is a plan view showing the application of a part of the lamp structure according to the second embodiment of the present invention.
Figure 8:
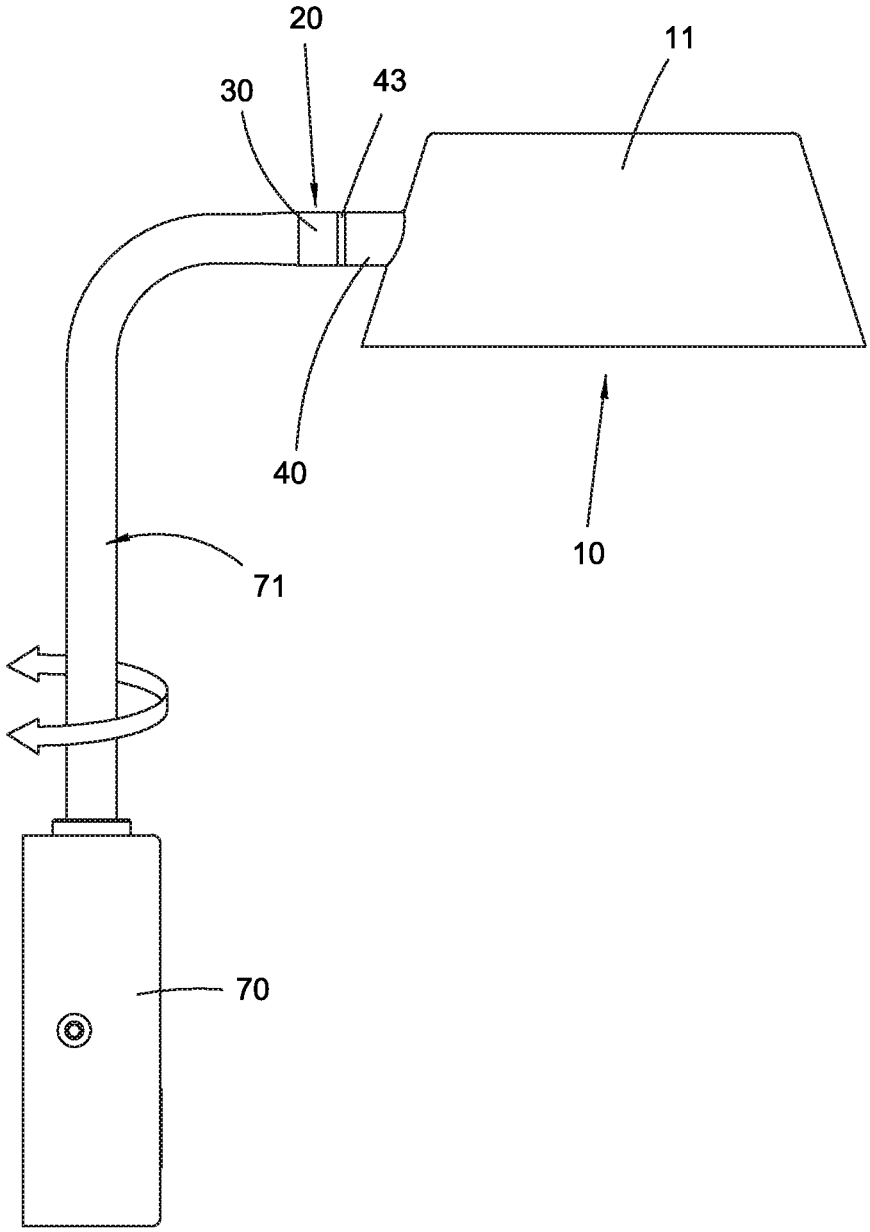
FIG. 8 is a plan view showing the application of the lamp structure according to the second embodiment of the present invention.
Figure 9:
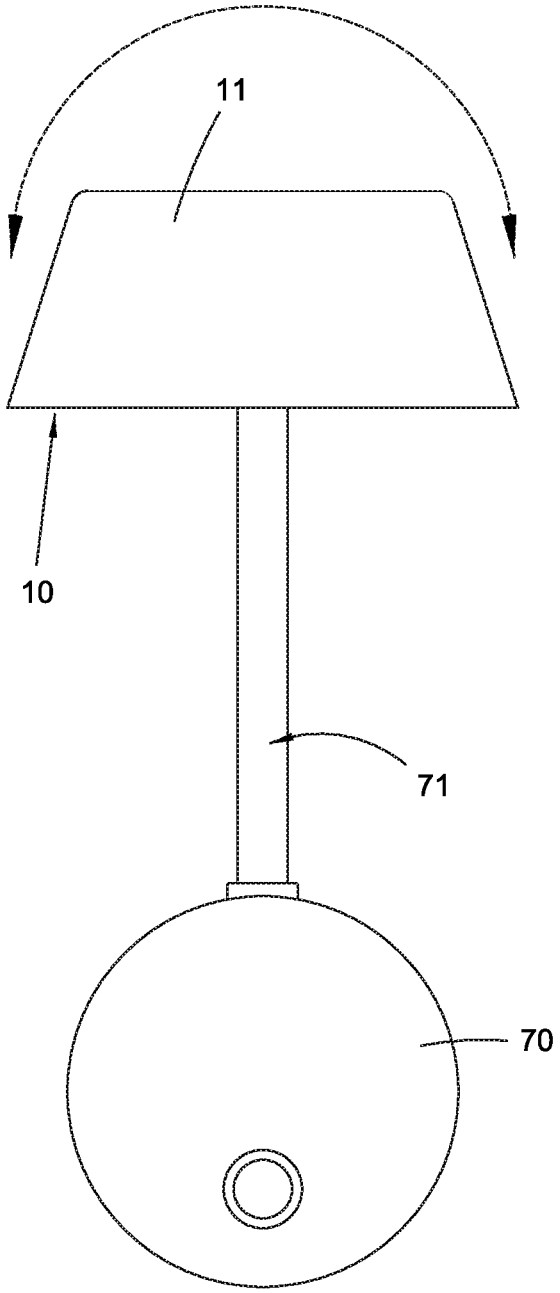
FIG. 9 is a plan view showing the application of the lamp structure according to the second embodiment of the present invention.

As shown in FIG. 2, in a second embodiment, the lamp structure 10 further comprises a rotatable connector 20 mounted on the lampshade 11 and configured to rotatably connect the lamp structure 10 with other components of a lamp, such as a mounting bracket 60 of a chandelier (as illustrated in FIGS. 4 and 5), a holder 70 of a wall lamp (as shown in FIGS. 6 and 7) or a connection rod 71 of the wall lamp (as shown in FIGS. 8 and 9).

The rotatable connector 20 includes a first connection set 30, a second connection set 40, and a rotary shaft 50.

A second end of the second connection set 40 is connected on an outer wall of the lampshade 11, and a first end of the first connection set 30 is coupled with other components of the lamp.

The rotary shaft 50 is tubular, the illumination element 13 is electrically connected with an electric wire 131 which is electrically connected with a power supply of the lamp through the first connection set 30, a second connection set 40, and the rotary shaft 50. A first segment 51 of the rotary shaft 50 is fixed after inserting into the first connection set 30. For example, the first segment 51 of the rotary shaft 50 has threads for screwing with the first connection set 30, a second segment of the rotary shaft 50 is rotatably inserted into the second connection set 40 so that the first connection set 30 and the second connection set 40 rotate along the rotary shaft 50. The first connection set 30 includes a stop protrusion 31 extending toward the second connection set 40 from a second end of the first connection set 30 and inserted between the second connection set 40 and the rotary shaft 50. The second connection set 40 includes a defining element 41 extending therealong and being a headless screw configured to stop the stop protrusion 31, such that the lamp structure 10 is rotated within a sectored range along the rotatable connector 20 (as illustrated in FIGS. 4, 7 and 9). The lamp structure 10 is connected with the mounting bracket 60 of the chandelier (as illustrated in FIGS. 4 and 5), the holder 70 of the wall lamp (as shown in FIGS. 6 and 7) or the connection rod 71 of the wall lamp (as shown in FIGS. 8 and 9). Thereby, the lamp structure 10 is rotated within the sectored range along the rotatable connector 20 so as to adjust its illuminating direction.

The first connection set 30 includes a hollow tube 32, a holder 33 which is tubular, and a threaded tube 34, wherein the holder 33 has the stop protrusion formed on a first end thereof, and the holder 33 has a screwing section 331 formed on a second end thereof so as to screw with a first end of the threaded tube 32, and a second end of the threaded tube 32 is screwed with the threaded tube 34, wherein the hollow tube 32 is connected with other components of the lamp via the threaded tube 34.

A first washer 43 is defined between the second end of the first connection set 30 and the first end of the second connection set 40, the rotary shaft 50 includes a rib 52 extending from a first end thereof, and a second washer 42 is defined between the rib 52 and the second end of the second connection set 40 so that the first connection set 30 and the second connection set 40 rotate along the rotary shaft 50.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An illumination structure for a lamp comprising: a lampshade, a transmission cap, and an illumination element;

wherein the lampshade is tubular, and the lampshade includes a first orifice and a second orifice which are defined on two ends of the lampshade respectively, wherein the lampshade is opaque and includes a reflective face formed on an inner wall thereof;

wherein the transmission cap is tubular and is accommodated in the lampshade, and a gap is defined between the transmission cap and the reflective face;

wherein the illumination element is defined between the transmission cap and the reflective face of the lampshade, wherein one part of lights penetrates through the transmission cap from the illumination element, another lights emit out of a front side of the lamp structure via the reflective face, the transmission cap and the first orifice, and the other lights illuminate out of a rear side of the lamp structure via the second orifice.

2. The illumination structure for the lamp as claimed in claim 1, wherein the lampshade is formed in a conical tube, and a diameter of the first orifice is more than the second orifice; the transmission cap is formed in a conical tube, and the transmission cap includes a first opening and a second opening which are formed on two ends of the transmission cap respectively, wherein a diameter of the first opening is more than a second opening of the transmission cap, the first opening is close to the first orifice of the lampshade, and the second opening is close to the second orifice of the lampshade.

3. The illumination structure for the lamp as claimed in claim 1, wherein the lampshade includes a circular top face formed on an end thereof, and the circular top face has the second orifice defined on a center thereof, the illumination element is received inside the circular top face, a second opening of the transmission cap is connected with the second orifice of the lampshade, and a first opening of the transmission cap is connected with the first orifice of the lampshade.

4. The illumination structure for the lamp as claimed in claim 2, wherein the circular top face of the lampshade includes a fixing plate, the fixing plate and the illumination element are fixed on an inner wall of the circular top face and are close to the second orifice; the illumination element is located below the fixing plate clamped between the inner wall of the circular top face and the illumination element, the fixing plate has a circular connection aperture having first threads, and the second opening of the transmission cap has second threads formed on an outer wall thereof, wherein the second threads of the transmission cap are screwed with the first threads of the circular connection aperture of the fixing plate.

5. The illumination structure for the lamp as claimed in claim 3, wherein the transmission cap is made of any one of matte glass, acrylic, and plastic.

6. The illumination structure for the lamp as claimed in claim 1, wherein the illumination element is any one of a circular LED light board, multiple light-emitting diodes (LEDs) which are arranged in a circular shape, and a circular fluorescent tube.

7. The illumination structure for the lamp as claimed in claim 1 further comprises a rotatable connector mounted on the lampshade and configured to rotatably connect the lamp with other components of a lamp.

8. The illumination structure for the lamp as claimed in claim 7, wherein the rotatable connector includes a first connection set, a second connection set, and a rotary shaft; a second end of the second connection set is connected on an outer wall of the lampshade, and a first end of the first connection set is coupled with other components of the lamp, a first segment of the rotary shaft is fixed after inserting into the first connection set, a second segment of the rotary shaft is rotatably inserted into the second connection set so that the first connection set and the second connection set rotate along the rotary shaft; the first connection set includes a stop protrusion extending toward the second connection set from a second end of the first connection set and inserted between the second connection set and the rotary shaft, the second connection set includes a defining element extending therealong and being a headless screw configured to stop the stop protrusion, such that the lamp is rotated within a sectored range along the rotatable connector.

9. The illumination structure for the lamp as claimed in claim 8, wherein a first washer is defined between the second end of the first connection set and the first end of the second connection set, the rotary shaft includes a rib extending from a first end thereof, and a second washer is defined between the rib and the second end of the second connection set so that the first connection set and the second connection set rotate along the rotary shaft.

10. The illumination structure for the lamp as claimed in claim 8, wherein the first connection set includes a hollow tube, a holder which is tubular, and a threaded tube, wherein the holder has the stop protrusion formed on a first end thereof, and the holder has a screwing section formed on a second end thereof so as to screw with a first end of the threaded tube, and a second end of the threaded tube is screwed with the threaded tube, wherein the hollow tube is connected with other components of the lamp via the threaded tube.

11. The illumination structure for the lamp as claimed in claim 9, wherein the first connection set includes a hollow tube, a holder which is tubular, and a threaded tube, wherein the holder has the stop protrusion formed on a first end thereof, and the holder has a screwing section formed on a second end thereof so as to screw with a first end of the threaded tube, and a second end of the threaded tube is screwed with the threaded tube, wherein the hollow tube is connected with other components of the lamp via the threaded tube.

* * * * *